US007241980B2

(12) United States Patent
Kim

(10) Patent No.: US 7,241,980 B2
(45) Date of Patent: Jul. 10, 2007

(54) CONTROL METHOD FOR A MICROWAVE OVEN

(75) Inventor: Hyun-Suk Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 278 days.

(21) Appl. No.: 10/282,096

(22) Filed: Oct. 29, 2002

(65) Prior Publication Data

US 2004/0031790 A1 Feb. 19, 2004

(30) Foreign Application Priority Data

Aug. 19, 2002 (KR) ..... 2002-49033

(51) Int. Cl.
*H05B 6/80* (2006.01)

(52) U.S. Cl. ..... 219/727; 219/702; 219/725; 219/715

(58) Field of Classification Search ..... 219/702, 219/727, 754, 720, 506, 732, 725, 704, 708, 219/715; 99/DIG. 14; 426/234, 241, 243
See application file for complete search history.

(56) References Cited

U.S. PATENT DOCUMENTS 4,870,238 A 9/1989 Hodgetts et al.
5,200,590 A * 4/1993 Bowen et al. ..... 219/727
5,302,790 A * 4/1994 Turpin ..... 219/727
5,357,086 A * 10/1994 Turpin et al. ..... 219/732
5,944,647 A * 8/1999 Reynolds ..... 493/405
5,958,482 A * 9/1999 Monforton ..... 426/107
6,396,035 B2 * 5/2002 Shon et al. ..... 219/702
6,686,575 B2 * 2/2004 Kim ..... 219/751

FOREIGN PATENT DOCUMENTS

JP 06101844 * 4/1994

OTHER PUBLICATIONS

Microwave Manual PMO-850, 2000, Palsonic Corp. Pty Ltd1 Joynton Ave., Waterloo Nsw 2017, Australia.*

* cited by examiner

*Primary Examiner*—Philip H. Leung
*Assistant Examiner*—Leonid M. Fastovsky
(74) *Attorney, Agent, or Firm*—Staas & Halsey LLP

(57) ABSTRACT

A control method for a microwave oven equipped with a tray installed in a cooking chamber to rotate a popcorn bag while having a popcorn cooking mode to cook popcorn. During cooking, rotation of the tray is temporarily stopped near the point of time when the popcorn bag is increased in size to a maximum size. Accordingly, problems caused by the fact that the popcorn bag comes into contact with the inner wall surface of the cooking chamber so that it cannot rotate are solved. The popcorn cooking mode is an operation mode to cook a popcorn product with corn grains packed in the popcorn bag in a state in which it is folded at least one time. The rotation of the tray is temporarily stopped near the point of time when the popcorn bag is estimated to achieve its maximum length as a folded portion of the popcorn bag is unfolded.

8 Claims, 6 Drawing Sheets

CONTROL METHOD FOR A MICROWAVE OVEN

CROSS-REFERENCE TO RELATED APPLICATIONS

This application claims the benefit of Korean Application No. 2002-49033, filed Aug. 19, 2002, in the Korean Industrial Property Office, the disclosure of which is incorporated herein by reference.

BACKGROUND OF THE INVENTION

1. Field of the Invention

The present invention relates to a microwave oven, and more particularly, to a control method for such a microwave oven, in particular, a microwave oven having a popcorn cooking mode to cook popcorn.

2. Description of the Related Art

Generally, microwave ovens are adapted to irradiate microwaves of 2,450 MHz onto food to be cooked, thereby cooking the food. The microwaves vibrate molecules of the food which are, in turn, struck against one another, thereby generating heat. By this heat, the food is cooked. FIG. 1 illustrates a general microwave oven. As illustrated in FIG. 1, the microwave oven includes an oven body 102, and a door 104 hingably mounted to the oven body 102 to open and dose a cooking chamber 106 defined in the oven body 102. A tray 110 is placed on the bottom surface 108 of the cooking chamber 106 within the cooking chamber 106. The tray 110 rotates during a cooking operation so that microwaves are uniformly transmitted to the entire portion of the food. A display unit 112 is provided at the front surface of the oven body 102 in order to display cooking time and other set values. A manipulation panel 114 is also provided, which has manipulation keys 116 to select a desired cooking mode, a desired cooking time, etc. When the user desires to cook food, the user manipulates the manipulation keys 116 to set a desired cooking condition in a state in which the food is placed on the tray 110, and then presses a cooking start key. In response to the start key, microwaves are transmitted to the food in a state in which the tray 110 rotates. Thus, the food is cooked.

Using such a microwave oven, various kinds of food can be cooked. For example, popcorn is a representative food capable of being cooked using a microwave oven. Popcorn products for microwave ovens are commercially available. In such a popcorn product, corn grains, that is, the raw material of popcorn, are contained in a paper bag in a sealed state. Cooking of such a popcorn product is carried out in a state in which the popcorn bag is placed in the microwave oven as it is. During the cooking operation, the corn grains contained in the sealed bag are popped as moisture escapes therefrom. That is, the moisture of corn grains is vaporized, so that the corn grains abruptly increase in volume, thereby forming popcorn. The popcorn has greatly increased volume as compared to the initial corn grains. Taking into consideration this fact, the popcorn bag should have a sufficiently large size.

FIG. 2 illustrates the alterations in the shape and size of a popcorn bag exhibited during a cooking operation carried out for corn grains contained in the popcorn bag using a microwave oven in accordance with a conventional control method. Referring to the part I of FIG. 2, a commercially-available popcorn product for microwave ovens is illustrated in which corn grains are contained in the central portion of a popcorn bag with opposite side portions being folded to overlap with each other. Accordingly, the commercially-available popcorn product illustrated in part I has a small size corresponding to only about ⅓ of the size of the popcorn bag in a popped state.

As the popcorn product is cooked, it size and shape are gradually changed, as illustrated in respective parts of FIG. 2. That is, as heating proceeds from an initial state shown in part I of FIG. 2, the folded portions of the popcorn bag are gradually unfolded, as illustrated in part II of FIG. 2. Subsequently, the popcorn bag becomes completely unfolded, as illustrated in part III of FIG. 2. As the heating operation is continued, the corn grains contained in the popcorn bag are popped, thereby causing their volume to increase gradually. As a result, the volume of the popcorn bag is also increased. At this time, however, the popcorn bag is reduced in length due to the volume increase thereof.

Although the content of the popcorn product may vary somewhat among different manufacturers, there are mainly two representative contents. In the United States of America, the home of popcorn, popcorn products with the largest content of 3.5 oz. are most popularly sold. In Korea, these popcorn products having the content of 3.5 oz. are most commonly imported and sold. Where the bottom area of the cooking chamber is smaller than that of the popcorn bag with the above mentioned large content, a problem occurs during a cooking operation. This will be described with reference to FIG. 3.

FIG. 3 is a view illustrating the state of the interior of the microwave oven during an operation to cook a popcorn product with a large content in accordance with the conventional control method. As a cooking operation is carried out under the condition in which the tray 110 rotates, the popcorn bag is completely unfolded to achieve its maximum length, as illustrated in part I of FIG. 3. Where the maximum length of the popcorn bag, that is, the length of the popcorn bag in the completely unfolded state, is longer than the shorter-side length of the bottom 108 of the microwave oven, the popcorn bag come into contact with the inner wall surface of the cooking chamber 106 at its corners, so that it no longer rotates even though the tray 110 rotates continuously. As a result, the popcorn bag is moved from the central portion of the cooking chamber 106 toward one corner of the cooking chamber 106, and finally stays at that corner.

For this reason, microwaves are non-uniformly transmitted to the popcorn bag. That is, there is a problem in that microwaves are insufficiently transmitted to the portion of the popcorn bag positioned adjacent to the corner of the cooking chamber 106.

SUMMARY OF THE INVENTION

Accordingly, it is an object of the present invention is to provide a control method for a microwave oven in which the tray of the microwave oven is temporarily stopped near the point of time when the popcorn bag of a popcorn product with a large content is completely unfolded within a cooking chamber during a cooking operation for the popcorn product, thereby preventing the popcorn bag from coming into contact with the inner wall surface of the cooking chamber, and thereby from staying at one corner of the cooking chamber.

Additional objects and advantages of the invention will be set forth in part in the description which follows and, in part, will be obvious from the description, or may be learned by practice of the invention.

The foregoing and other objects of the present invention are achieved by providing a control method for a microwave oven equipped with a tray installed in a cooking chamber to rotate a popcorn bag while having a popcorn cooking mode to cook popcorn, wherein rotation of the tray is temporarily stopped near the point of time when the popcorn bag is increased in size to a maximum size in the popcorn cooking mode. Accordingly, it is possible to solve problems caused by the fact that the popcorn bag comes into contact with the inner wall surface of the cooking chamber, so that it cannot rotate. The popcorn cooking mode is an operation mode to cook a popcorn product with corn grains packed in the popcorn bag in a state which is folded at least one time. The rotation of the tray is temporarily stopped near the point of time when the popcorn bag is estimated to achieve a maximum length thereof as a folded portion of the popcorn bag is unfolded.

BRIEF DESCRIPTION OF THE DRAWINGS

These and other objects and advantages of the invention will become apparent and more readily appreciated from the following description of the embodiments, taken in conjunction with the accompanying drawings of which.

DESCRIPTION OF THE PREFERRED EMBODIMENTS

Figure 1:
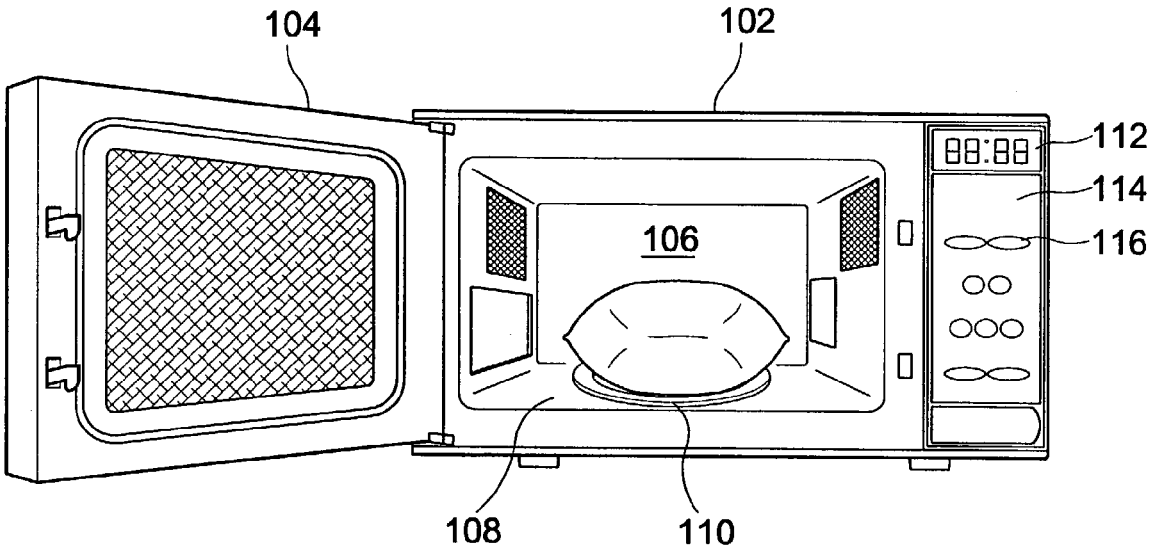
FIG. 1 (PRIOR ART)
FIG. 1 is a view illustrating a general microwave oven.
Figure 2:
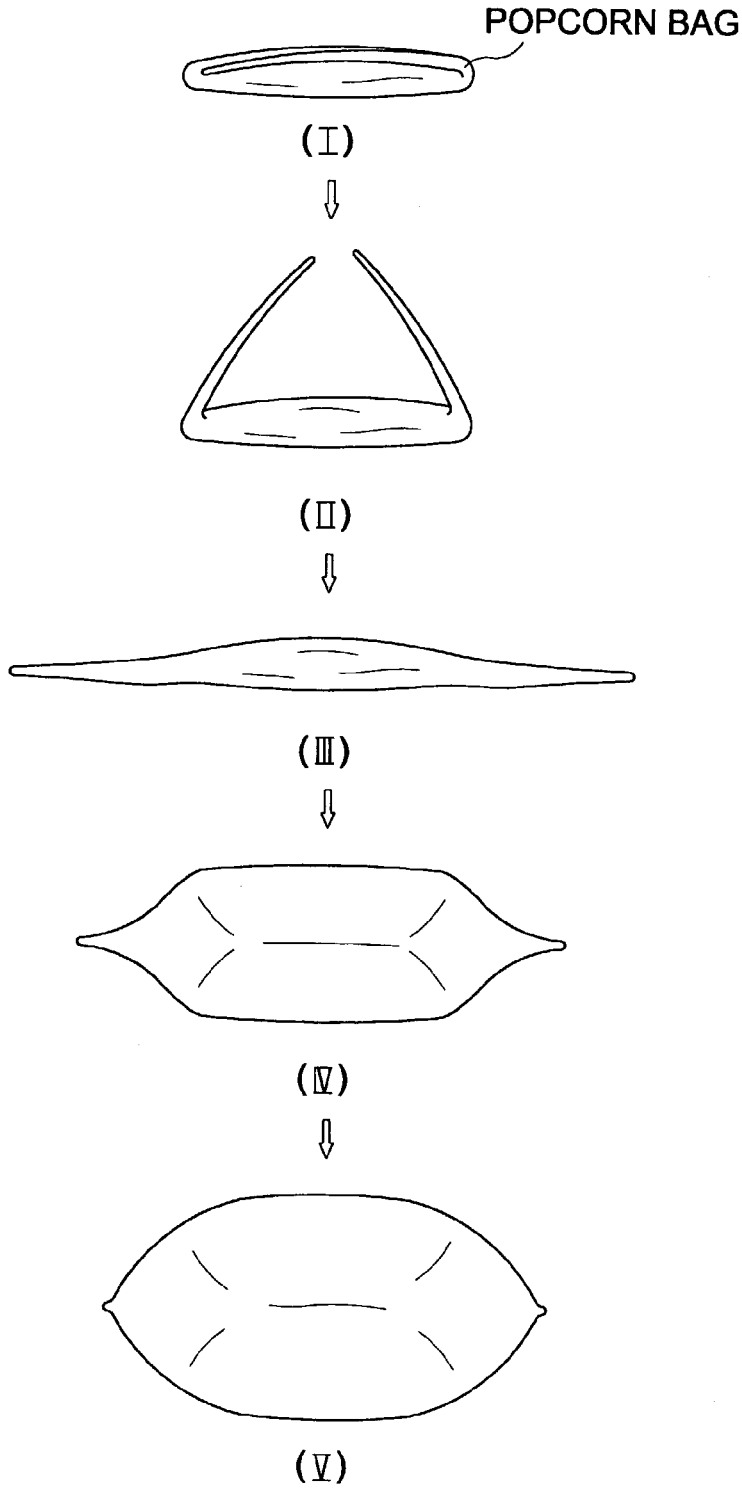
FIG. 2 (PRIOR ART)
FIG. 2 illustrates the alterations in the shape and size of a popcorn bag exhibited during a cooking operation carried out for corn grains contained in the popcorn bag using a microwave oven in accordance with a conventional control method.
Figure 3:
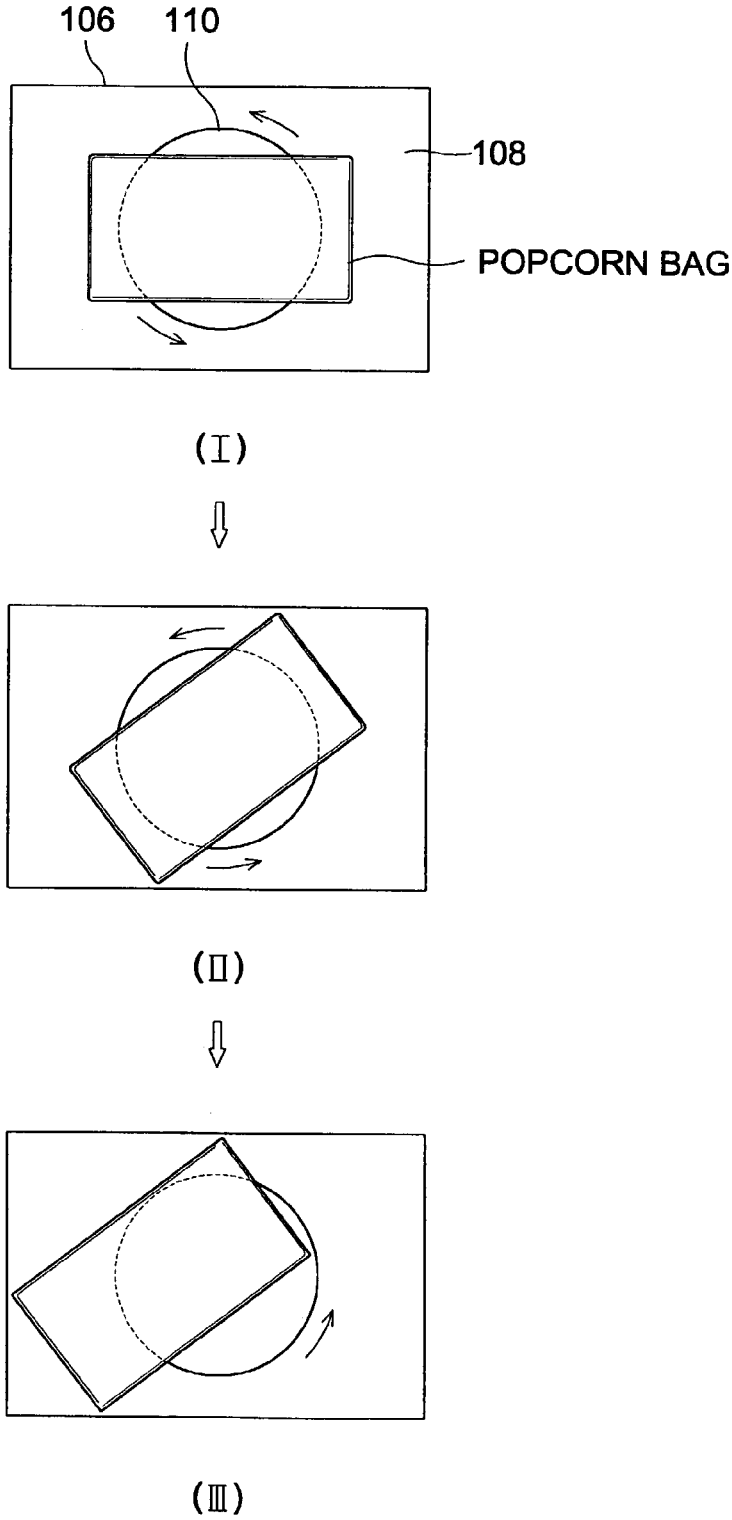
FIG. 3 (PRIOR ART)
FIG. 3 is a view illustrating the state of the interior of the microwave oven during an operation to cook a popcorn product with a large content in accordance with the conventional control method.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 4:
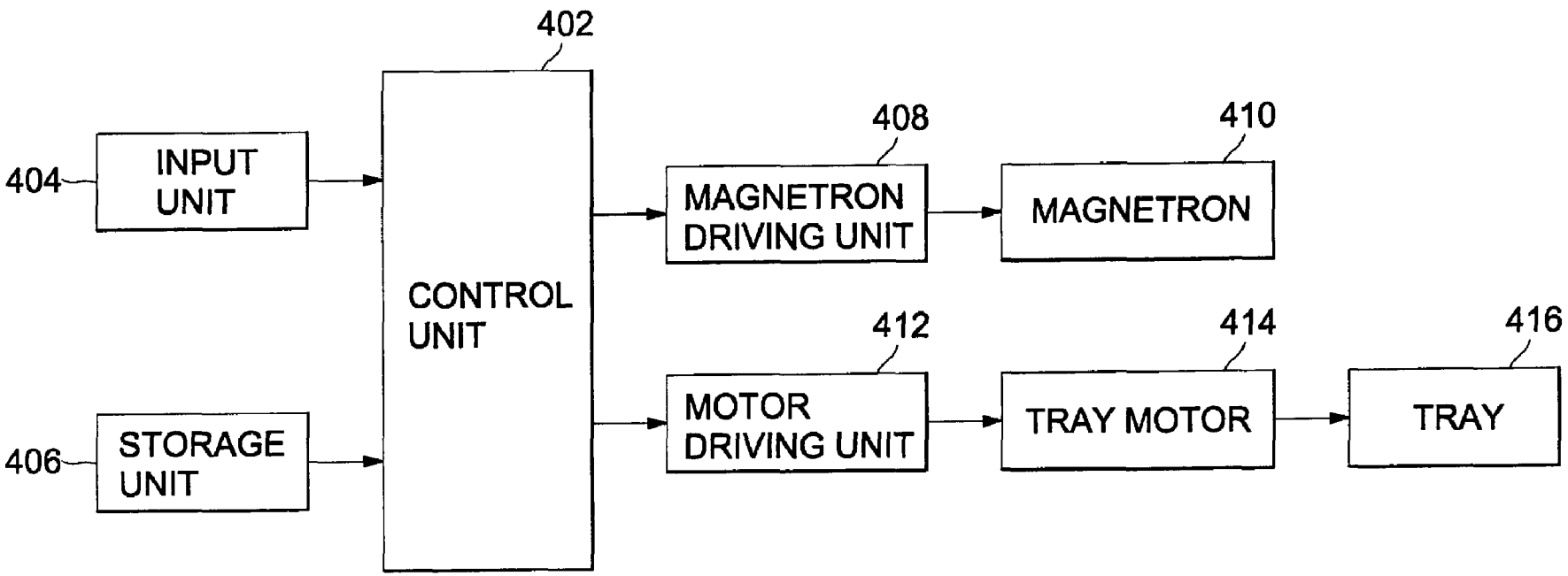
FIG. 4 is a block diagram illustrating the configuration of a microwave oven to which the control method according to an embodiment of the present invention is applied.

A control method for a microwave oven according to an embodiment of the present invention will be described with reference to FIGS. 4 to 6. FIG. 4 is a block diagram illustrating the configuration of a microwave oven to which the control method of the present invention is applied. As illustrated in FIG. 4, an input unit 404 and a storage unit 406 are connected to the input of a control unit 402 adapted to control the overall operation of the microwave oven. The input unit 404 is equipped with various keys including a cooking mode setting key, and number keys to allow the user to set a desired cooking mode, a desired cooking time, etc. The cooking mode setting key may be used to select a popcorn cooking mode. The storage unit 406 is stored with data required to cook, for example, various cooking methods associated with various kinds of food. A magnetron driving unit 408 and a motor driving unit 412 are connected to the output of the control unit 402. The magnetron driving unit 408 drives a magnetron 410 so that microwaves are generated from the magnetron 410. The motor driving unit 412 drives a tray motor 414 to rotate a tray 416 installed in a cooking chamber defined in the microwave oven.

The control unit 402, which is adapted to control the overall operation of the microwave oven, controls rotation of the tray 416 in the state where a popcorn bag is received in the cooking chamber in a popcorn cooking mode, so as to maintain the popcorn bag at the central portion of the cooking chamber even when a popcorn product with a large content is cooked. Such a control concept of the control unit 402 will be described with reference to FIG. 5.

Figure 5:
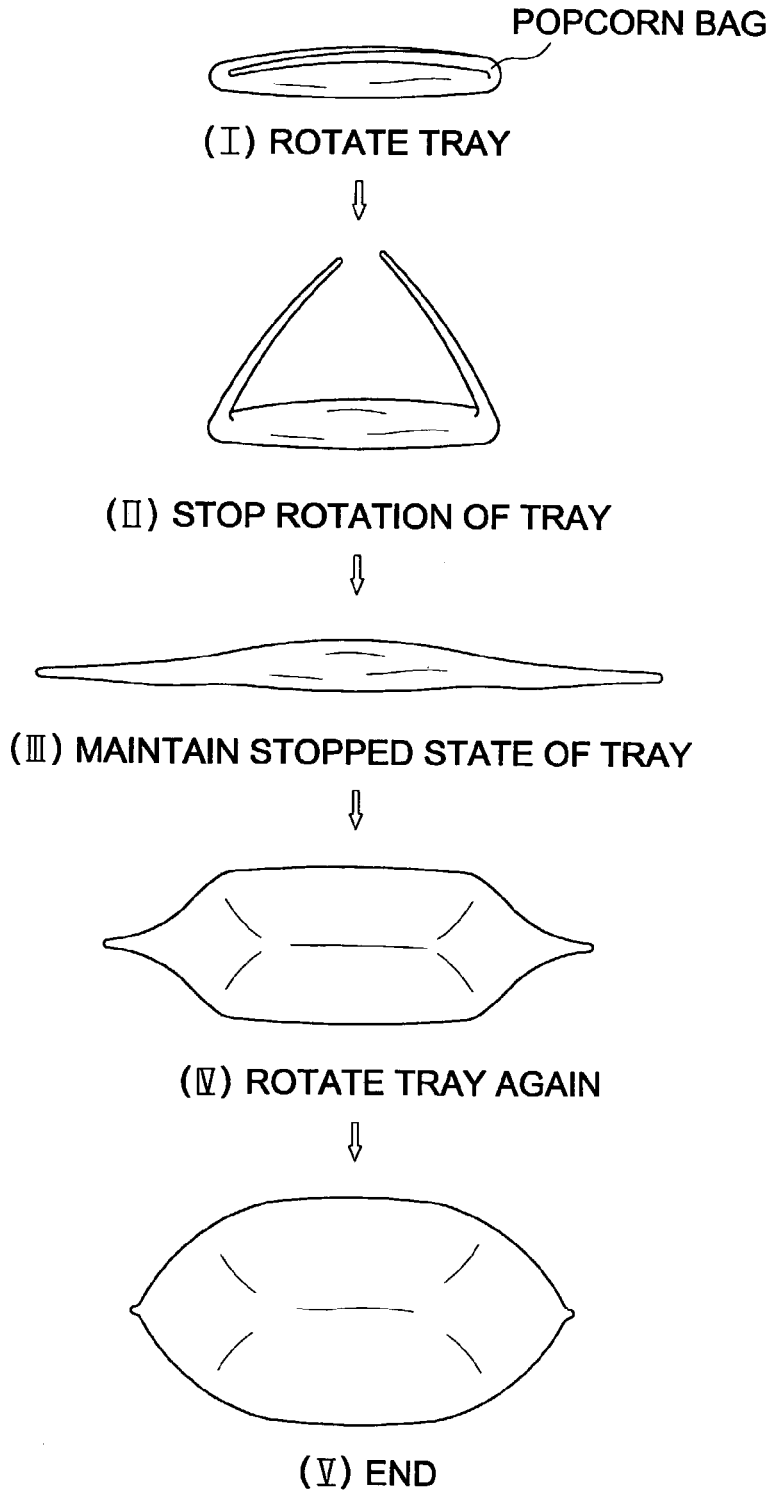
FIG. 5 is a view illustrating states of a popcorn bag sequentially exhibited when its popcorn product is cooked using the microwave oven in accordance with the control method of the present invention, along with states of the tray associated with respective states of the popcorn bag.
Figure 6:
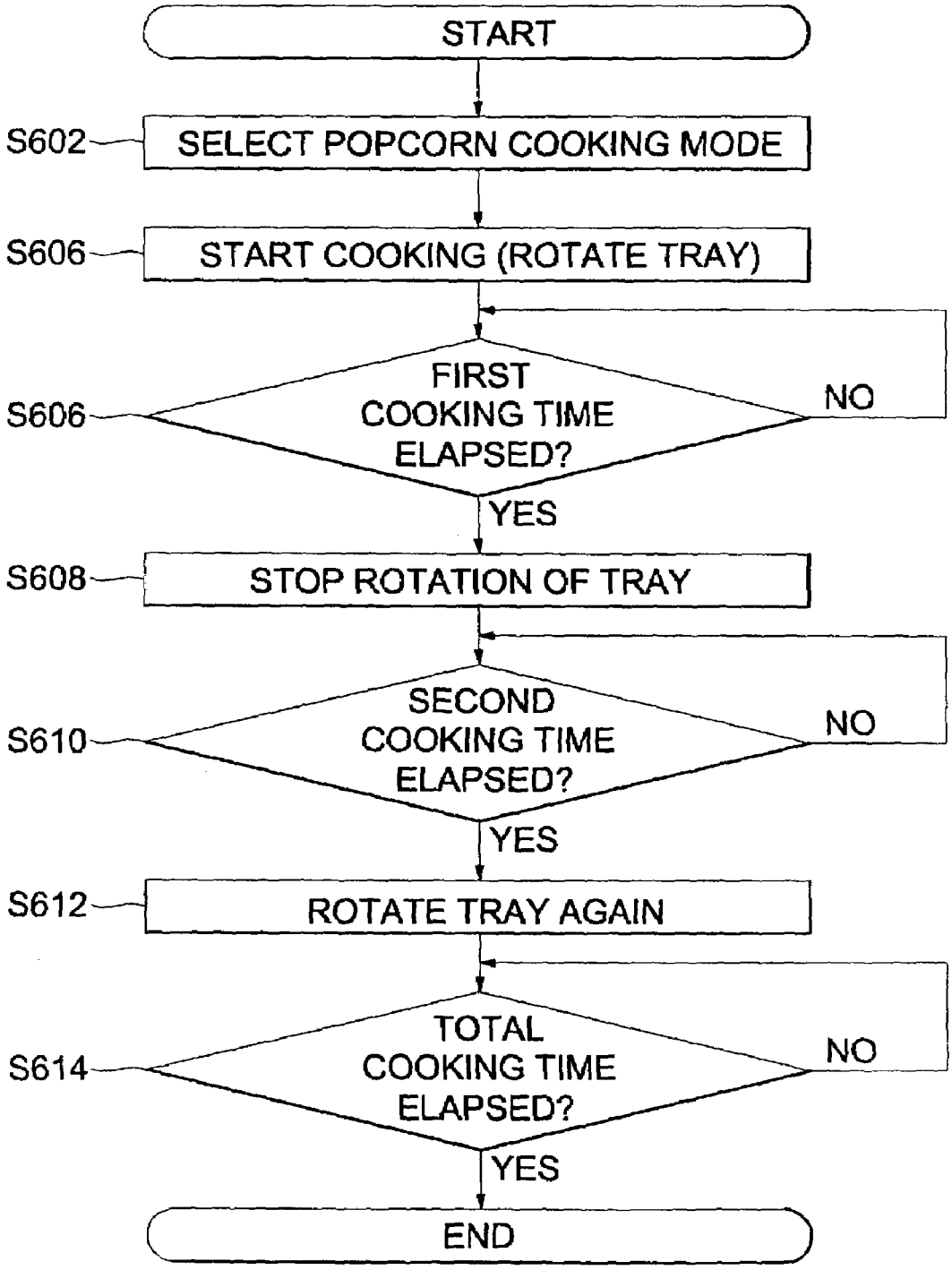
FIG. 6 is a flow chart illustrating a popcorn cooking procedure carried out in the microwave oven in accordance with the control method of the present invention.

FIG. 5 is a view illustrating states of a popcorn bag sequentially exhibited when its popcorn product is cooked using the microwave oven having the above described configuration in accordance with the control method of the present invention, along with states of the tray associated with respective states of the popcorn bag. As illustrated in FIG. 5, at the beginning of the popcorn cooking mode, the popcorn bag is maintained in an initial state thereof in which corn grains are contained in the central portion of a popcorn bag with opposite side portions being folded to overlap with each other. As the popcorn bag is heated, the folded portions of the popcorn bag are gradually unfolded, as illustrated in part II of FIG. 5. At this time, the control unit 402 stops the tray motor 414, thereby preventing the tray 416 from rotating. The point of time when the control unit 402 stops the rotation of the tray 416 is determined based on data about a first cooking time stored in the storage unit 406. In accordance with the present invention, the first cooking time in the popcorn cooking mode has a time span from the point of time when the popcorn cooking mode is begun to the point of time just before the folded portions of the popcorn bag are unfolded. This first cooking time is determined through experiments carried out in the development procedure of popcorn products. That is, the product developer collects data about the point of time when the unfolded portions of the popcorn bag with a large content begin to be unfolded, after repeatedly conducting a cooking procedure for the popcorn bag. Based on the collected data, the shortest time is determined as the first cooking time. Alternatively, the first cooking time may be determined based on an average value of the collected data while taking into consideration a tolerance range of the average value.

Following the first cooking time, the tray 416 is maintained in its stopped state for a second cooking time. When the second cooking time has elapsed, the control unit 402 controls the tray motor 414 to again rotate the tray 416. The second cooking time corresponds to the time for which the tray 416 is maintained in its stopped state. For the second cooking time, the corn grains are popped within the popcorn bag, so that the popcorn bag is somewhat increased in volume, as illustrated in part IV of FIG. 5. As the volume of the popcorn bag increases, the length of the popcorn bag is slightly reduced. Accordingly, the popcorn bag can rotate along with the tray 416 without coming into contact with the inner wall surface of the Cooking chamber. The second cooking time may also be determined through experiments, similarly to the first cooking time.

When the second cooking time has elapsed, the control unit 402 operates to again rotate the tray 416. As described above, the popcorn bag can rotate along with the tray 416 after the elapse of the second cooking time because its length is reduced due to its volume increase during the second cooking time. As the popcorn bag rotates along with the tray 416, microwaves can be uniformly transmitted to the entire portion of the popcorn bag so that the corn grains are sufficiently popped within the popcorn bag. When the total cooking time set for the popcorn cooking mode has elapsed, the popcorn cooking procedure is completed.

Now, the above described microwave oven control method according to the present invention will be described in detail with reference to FIG. 6. FIG. 6 is a flow chart illustrating a popcorn cooking procedure carried out in the microwave oven in accordance with the microwave oven control method of the present invention. As illustrated in FIG.6, when the popcorn cooking mode is selected (S602), the control unit 402 operates to drive the magnetron 410, thereby generating microwaves. The control unit 402 also operates to rotate the tray 416, so that the popcorn bag is rotated to begin a popcorn cooking procedure (S604). The control unit 402 then checks whether or not a first cooking time has elapsed after the beginning of the first cooking time (S606). When the first cooking time has elapsed, the control unit 402 stops the tray motor 414, thereby stopping the rotation of the tray 416 (S608). In this state, the popcorn bag is still maintained at the central portion of the cooking chamber where the tray 416 is arranged, without being moved to one corner of the cooking chamber, because the tray 416 does not rotate after the first cooking time. Once the rotation of the tray 416 is stopped, the control unit 402 checks whether or not the second cooking time has elapsed during the popcorn cooking procedure (S610). When the second cooking time has elapsed, the control unit 402 rotates the tray 416 (S612) once again. At the point of time when the tray 416 rotates again, the popcorn bag is in a state in which its volume is increased, and its length is slightly reduced, because the corn grains have been popped to a certain degree. Accordingly, the popcorn bag is rotated along with the tray 416 without being moved to one corner of the cooking chamber, so that microwaves are uniformly transmitted to the entire portion of the popcorn bag. Once the tray 416 rotates again, the control unit 402 checks whether or not the total cooking time has elapsed (S614). When the total cooking time has elapsed, the popcorn cooking mode is completed.

As apparent from the above description, the microwave oven control method of the present invention carries out a control operation to stop rotation of the tray before the popcorn bag is completely unfolded to achieve its maximum length, and subsequently rotates the tray again when the popcorn bag has a length reduced from the maximum length as its volume is increased in accordance with the proceeding of the popping procedure. In accordance with such a control operation, it is possible to prevent the popcorn bag from coming into contact with the inner wall surface of the cooking chamber in the microwave oven during a popcorn cooking procedure where the popcorn bag is of a large content, and thereby from staying at one corner of the cooking chamber.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A control method for a microwave oven having a popcorn cooking mode, comprising:

obtaining data of a point of time when a popcorn bag laid on a tray rotatably installed in a cooking chamber defined in the microwave oven is increased in size to a maximum size as it is heating;

storing the data in a storage unit;

temporarily stopping rotation of the tray via a control unit near the point of time when the popcorn bag laid on the tray is increased in size to the maximum size based on the data stored in the storage unit in the popcorn cooking mode; and restarting rotation of the tray when the popcorn bag is reduced in length due to an increased volume thereof in accordance with an expansion thereof.

2. The control method according to claim 1, wherein the popcorn cooking mode is an operation mode to cook a popcorn product with corn grains packed in the popcorn bag which is in a state of being folded at least one time.

3. The control method according to claim 2, wherein the rotation of the tray is temporarily stopped near the point of time when the popcorn bag is estimated to achieve a maximum length thereof as a folded portion of the popcorn bag is unfolded.

4. A control method for a microwave oven having a popcorn cooking mode to cook a popcorn product with corn grains packed in a popcorn bag folded at least one time, comprising:

obtaining data of a point of time when a popcorn bag laid on a tray rotatably installed in a cooking chamber defined in the microwave oven is completely unfolded as it is heating;

storing the data in a storage unit;

heating the corn grains packed in the popcorn bag in the popcorn cooking mode;

stopping rotation of the tray via a control unit before the popcorn bag is completely unfolded as it is heated based on the data stored in the storage unit; and rotating the tray again when the popcorn bag is reduced in length due to an increased volume thereof in accordance with an expansion thereof.

5. A control method for a microwave oven having a mode to cook foods placed in an expandable cooking bag, wherein a tray installed in a cooking chamber within the microwave oven rotates during cooking, the method comprising:

obtaining data of a point of time when a cooking bag laid on the tray expands as it is heating;

storing the data in a storage unit;

temporarily stopping rotation of the tray via a control unit immediately prior to a position in which the expandable cooking bag expands based on the data stored in the storage unit, preventing the cooking bag from contacting opposite sides of the cooking chamber; and restarting rotation of the tray once the expandable bag has reached an expanded position wherein a length of the expandable bag has decreased as the bag reaches the expanded position.

6. The control method according to claim 5, wherein the expanded position is a fully expanded position.

7. A control method for a microwave oven having a mode to cook foods placed in an expandable cooking bag, wherein a tray installed in a cooking chamber within the microwave oven rotates during cooking, the method comprising:

obtaining data of a point of time when a cooking bag laid on the tray expands as it is heating;

storing the data in a storage unit;

temporarily stopping rotation of the tray via a control unit as soon as the cooking bag expands based on the data stored in the storage unit, preventing the cooking bag from contacting at least two sides of the cooking; and restarting rotation of the tray once the expandable bag has reached an expanded position wherein a length of the expandable bag has decreased as the bag reaches the expanded position.

8. The control method according to claim 7 wherein the expanded position is a fully expanded position.

* * * * *

UNITED STATES PATENT AND TRADEMARK OFFICE

CERTIFICATE OF CORRECTION

PATENT NO. : 7,241,980 B2
APPLICATION NO. : 10/282096
DATED : July 10, 2007
INVENTOR(S) : Hyun-Suk Kim It is certified that error appears in the above-identified patent and that said Letters Patent is hereby corrected as shown below:

Column 6, Line 67, Claim 7, change “cooking;” to --cooking chamber;--.

Signed and Sealed this

Fourth Day of December, 2007

JON W. DUDAS
*Director of the United States Patent and Trademark Office*